United States Patent [19]

Hart et al.

[11] Patent Number: 4,504,762

[45] Date of Patent: Mar. 12, 1985

[54] BUFFER FOR AN ELECTRON BEAM COLLECTOR

[75] Inventors: Stephen L. Hart, Torrance; Theodore G. Anderson, II, Rancho Palos Verdes, both of Calif.

[73] Assignee: Hughes Aircraft Company, El Segundo, Calif.

[21] Appl. No.: 392,197

[22] Filed: Jun. 25, 1982

[51] Int. Cl.[3] ..... H01J 1/02; H01J 25/34; H01J 61/52

[52] U.S. Cl. ..... 313/30; 313/18; 313/46; 315/3.5; 315/5.38

[58] Field of Search ..... 313/30, 18, 46; 315/3.5, 5.38

[56] References Cited

U.S. PATENT DOCUMENTS

| | | | |
|---|---|---|---|
| 3,626,230 | 12/1971 | Stewart | 313/30 |
| 3,666,980 | 5/1972 | Jackson | 313/30 X |
| 3,717,787 | 2/1973 | Doyle | 313/18 X |
| 3,823,772 | 7/1974 | Lavering et al. | 313/18 X |

*Primary Examiner*—David K. Moore
*Assistant Examiner*—K. Wieder
*Attorney, Agent, or Firm*—J. Holtrichter, Jr.; W. J. Bethurum; A. W. Karambelas

[57] ABSTRACT

A buffer is provided for protecting the electron beam collector of a traveling wave tube. The collector comprises an elongated tubular wall, an elongated tubular insulating wall of one type of material, an elongated cylindrical electrode of another type of material coaxially positioned within the insulating wall, and the buffer interposed between the electrode and the insulating wall. The buffer comprises a continuous web of buffer material capable of being bonded to dissimilar insulating wall material and electrode material. The web having an alternating pattern of corrugations, the vertices of the corrugations are generally planar which define two generally parallel, planar surfaces which in turn are adapted for bonding to the insulating wall and the electrode.

6 Claims, 2 Drawing Figures

BUFFER FOR AN ELECTRON BEAM COLLECTOR

TECHNICAL FIELD

This invention relates to traveling wave tubes and, more particularly, to the collectors of such traveling wave tubes.

BACKGROUND OF THE INVENTION

1. Field of the Invention

In traveling wave tubes, an electron gun is generally disposed at one end of the tube and a collector at the other end. Collectors are necessary in collecting a beam of electrons which emanates from the electron gun. For insulated collectors, the collector generally comprises a tubular wall, a tubular insulating wall, a cylindrical electrode positioned within the insulating wall, and a buffer interposed between the electrode and the insulating wall. A novel buffer is the subject of the present invention.

2. Description of the Prior Art

In general, the collector electrode is bonded directly to the insulating wall. The bonding ensures the proper alignment of the electrode and facilitates the efficacious dissipation of heat from the electrode to the exterior of the collector wall. When the electrode undergoes extreme operational temperatures, its expansion and contraction invariably causes the insulating wall-to-electrode bonds to sever. One remedy for this problem is to machine helical slots on the external surface of the electrode in order to permit the expansion and contraction of the electrode. Frequently, the slots extend to the internal surface of the electrode. Another remedy is to use buffers between the electrode and the insulating wall. For example, rings are disclosed in U.S. Pat. No. 3,626,230, by Stewart and U.S. Pat. No. 3,317,787, by Doyle.

However, the prior art devices are deficient. One deficiency is that the machining of helical slots on the electrode is extremely time consuming and expensive. Another deficiency is that the assembly and manufacturing of rings are equally time consuming and expensive.

SUMMARY OF THE INVENTION

In view of the prior art, it is a primary purpose of the present invention to provide a novel buffer for the electron beam collector of a traveling wave tube.

It is another purpose of the present invention to provide a novel buffer which is capable of being bonded to two dissimilar materials.

It is a further purpose of the present invention to provide a novel buffer which is capable of maintaining thermal conductivity between the two dissimilar materials.

It is another further purpose of the present invention to provide a novel buffer which is capable of relieving mechanical stresses between the two dissimilar materials.

In order to accomplish the above and still further purposes, the present invention provides a novel buffer for protecting the electron beam collector of a traveling wave tube. In general, the collector comprises an elongated tubular wall, an elongated tubular insulating wall, an elongated cylindrical electrode coaxially positioned within the insulating wall, and a buffer interposed between the electrode and the insulating wall. The tubular insulating wall comprises one type of material, and the electrode comprises another type of material. The collector further comprises a cylindrical end-piece having a beam entrance aperture which is adapted to receive a beam of electrons. Similarly, the electrode has a corresponding beam entrance aperture.

More particularly, and in accordance with the present invention, the buffer comprises a continuous web of buffer material which is capable of being bonded to dissimilar insulating wall material and electrode material. The web has an alternating pattern of corrugations. The vertices of the corrugations are generally planar and define two generally parallel, planar surfaces adapted for bonding to the insulating wall and the electrode. Thus, the continuous web of corrugations permits the expansion and contraction of the insulating wall and the electrode by absorbing mechanical stresses exerted by the insulating wall and the electrode. Further, the continuous web of corrugations maintains the thermal conductivity between the insulating wall and the electrode.

One advantage of the present invention is that a novel buffer is provided for the electron beam collector of a traveling wave tube.

Another advantage of the present invention is that the novel buffer is capable of being bonded to two dissimilar materials.

A further advantage of the present invention is that the novel buffer is capable of maintaining the thermal conductivity between the two dissimilar materials.

Another further advantage of the present invention is that the novel buffer is capable of relieving the mechanical stresses between the two dissimilar materials.

Other purposes, features and advantages of the present invention will appear from the following detailed description of a preferred embodiment thereof, taken together with the accompanying drawings.

DETAILED DESCRIPTION OF THE INVENTION

Figure 1:
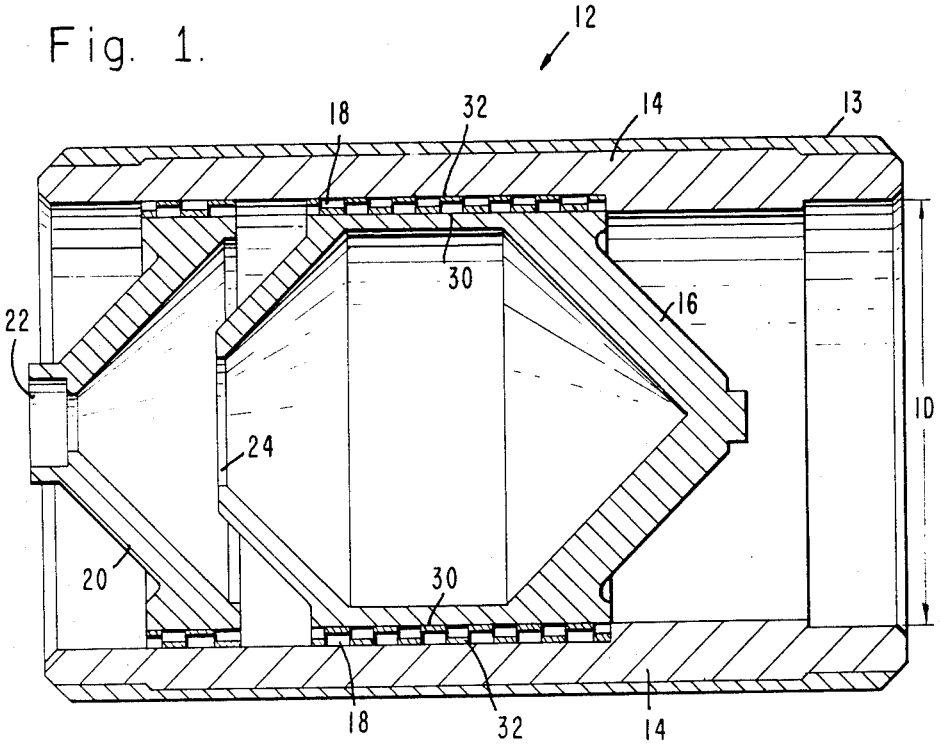
FIG. 1 is a simplified cross-sectional view of an electron beam collector comprising a buffer in accordance with the present invention.

Referring to FIG. 1, there is shown an electron beam collector, generally designated 12, for a traveling wave tube, not shown. Collector 12 generally comprises an elongated tubular outer wall 13, an elongated tubular insulating wall 14 of one type of material, an elongated cylindrical electrode 16 of another type of material coaxially positioned within collector insulating wall 14, and a buffer 18 interposed between electrode 16 and insulating wall 14. Further, collector 12 comprises a cylindrical end-piece 20 which has a beam entrance aperture 22, which in turn is adapted to receive a beam of electrons, not shown. Similarly, electrode 16 has a corresponding beam entrance aperture 24.

Figure 2:
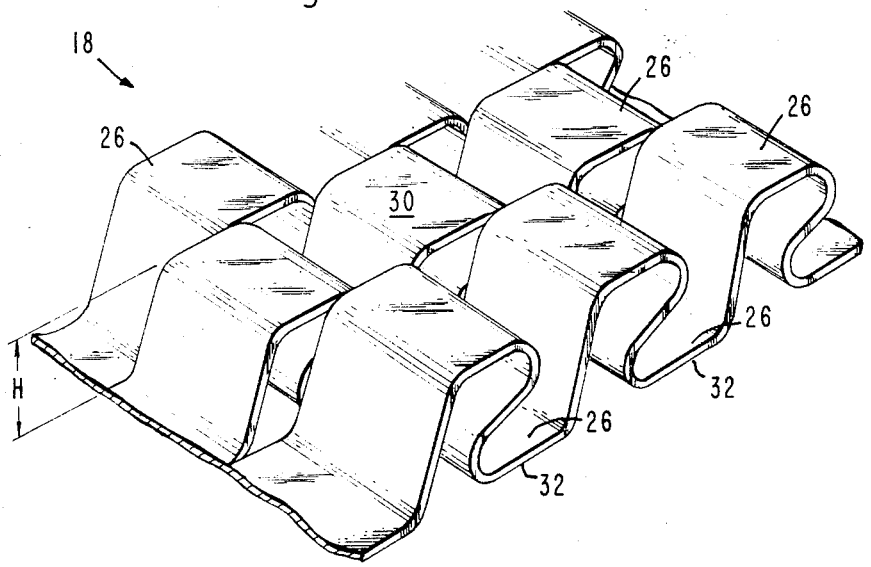
FIG. 2 is an enlarged, partial perspective view of the buffer of FIG. 1.

In accordance with the present invention, buffer 18 comprises a continuous and flexible web of buffer material which is capable of being bonded to dissimilar insulating wall material and electrode material, as best shown in FIG. 2. Buffer 18 has an alternating pattern of corrugations 26. The vertices of corrugations 26 are generally planar which define two generally parallel, planar surfaces 30, 32, which in turn are adapted for bonding to insulating wall 14 and electrode 16.

In exemplary collector 12, the material of insulating wall 14 comprises a dielectric such as aluminum oxide with a coefficient of expansion of approximately 8 mils per inch at 1000° C. The inner diameter ID of insulating wall 14 is approximately 2.0 inches. For exemplary electrode 16, the material comprises oxygen-free copper with a coefficient of expansion of approximately 20 mils per inch at 1000° C. Since collector 12 is contained within a vacuum environment, its components must be free of oxygen which may contaminate the cathode of the electron gun.

For exemplary buffer 18, in accordance with the present invention, the material comprises oxygen-free copper. The height H of buffer 18, from vertex 26 to vertex 26, is approximately 0.065 inches. In manufacturing buffer 18, an 11×6 inch piece of a web is subjected to a vertical force of approximately 22 tons. This force reduces the height of buffer 18 from approximately 0.107 inches to 0.065 inches to create the planar vertices. The sum of the planar portions of corrugation vertices 26 on each side of buffer 18 is approximately 64% of the total area of each of the planar surfaces 30, 32. This amount of planar area ensures proper brazing of buffer 18 to insulating wall 14 and electrode 16. Buffer 18 is readily brazed onto insulating wall 14 and electrode 16 by conventional brazing techniques.

In operation, buffer 18, due to corrugations 26, permits the free expansion and contraction of the dissimilar materials to electrode 16 and insulating wall 14 such that the bonds are not severed. Corrugations 26 readily alter their shapes as they absorb the mechanical stresses between insulating wall 14 and electrode 16. The mechanical stresses are taken up by buffer 18 and not by the electrode-to-insulating wall interface. Thus, the useful life of collector 12 is enhanced because the bonds are intact. In addition, buffer 18 maintains thermal conductivity between electrode 16 and insulating wall 14 to allow dissipation of heat from electrode 16 to the exterior of collector 12.

It will be apparent to those skilled in the art that various modifications may be made within the spirit of the invention and the scope of the appended claims. For example, the material for insulating wall 14 may comprise beryllium oxide or magnesium oxide; the material for electrode 16 may comprise molybdenum or titanium. The material for buffer 18 may comprise any elastic material which readily bonds to two dissimilar materials. Or, the dimensions of buffer 18 may be varied such as height H or the number of corrugations 26 per square inch. In addition, buffer 18 may be placed at positions other than the insulating wall-to-electrode interface. As shown in FIG. 1, buffer 18 is placed between collector end-piece 20 and insulating wall 14.

What is claimed is:

1. A buffer for protecting the electron beam collector of a travelling wave tube, said collector comprising an elongated tubular wall, an elongated tubular insulating wall of one type of material, an elongated cylindrical electrode of another type of material coaxially positioned within said insulating wall, and said buffer interposed between said electrode and said insulating wall, said collector further comprising a cylindrical end-piece having a beam entrance aperture which is adapted to receive a beam of electrons, and said electrode having a corresponding beam entrance aperture, said buffer comprising:

a continuous web of buffer material capable of being bonded to dissimilar said insulating wall material said electrode material, said web having an alternating pattern of corrugations, the vertices of said corrugations being generally planar and defining two generally parallel, planar surfaces adapted for bonding to said insulating wall and said electrode, said vertices of said corrugations being offset and nonaligned in adjacent rows so as to prevent the trapping of gases between said planar surfaces and thereby enhance the thermal dissipation capability of said collector, whereby said continuous web of corrugations permits expansion and contraction of said insulating wall and said electrode by absorbing mechanical stresses, and said continuous web of corrugations maintains thermal conductivity between said insulating wall and said electrode.

2. The buffer as claimed in claim 1, wherein said insulating wall material comprises a dielectric material selected from the group consisting of aluminum oxide, beryllium oxide, and magnesium oxide.

3. The buffer as claimed in claim 2, wherein said electrode material comprises a metallic material selected from the group consisting of oxygen-free copper, molybdenum, and titanium.

4. The buffer as claimed in claim 3, wherein said insulating wall material comprises aluminum oxide and said electrode material comprises oxygen-free copper.

5. The buffer as claimed in claim 4, wherein said buffer material comprises oxygen-free copper.

6. The buffer as claimed in claim 5, wherein said buffer is bonded to both said insulating wall and said electrode by brazing.

* * * * *